US007024448B2

(12) United States Patent
Matsugaki et al.

(10) Patent No.: US 7,024,448 B2
(45) Date of Patent: Apr. 4, 2006

(54) MULTIPLIER

(75) Inventors: Yoshikatsu Matsugaki, Oita (JP); Eizo Fukui, Beppu (JP)

(73) Assignee: Texas Instruments Incorporated, Dallas, TX (US)

( * ) Notice: Subject to any disclaimer, the term of this patent is extended or adjusted under 35 U.S.C. 154(b) by 630 days.

(21) Appl. No.: 10/308,620

(22) Filed: Dec. 3, 2002

(65) Prior Publication Data

US 2003/0110199 A1 Jun. 12, 2003

(30) Foreign Application Priority Data

Dec. 11, 2001 (JP) ..... 2001-376873

(51) Int. Cl.
*G06G 7/16* (2006.01)

(52) U.S. Cl. ..... 708/835; 327/356

(58) Field of Classification Search ..... 708/835; 327/356

See application file for complete search history.

(56) References Cited

U.S. PATENT DOCUMENTS 4,764,892 A * 8/1988 Thomas ..... 327/356
5,877,974 A * 3/1999 Can ..... 708/835
5,926,408 A * 7/1999 Kimura ..... 708/835
5,931,899 A * 8/1999 Kertis ..... 708/835
2001/0048336 A1* 12/2001 Amano ..... 327/359

* cited by examiner

*Primary Examiner*—Tan V. Mai
(74) *Attorney, Agent, or Firm*—William B. Kempler; W. James Brady, III; Frederick J. Telecky, J r.

(57) ABSTRACT

A multiplier having a simple constitution, excellent performance with respect to high-frequency characteristics and distortion characteristics, and allows low-voltage operation. Transistor Q11, resistors R11 and R12 form a common-emitter circuit. One signal of differential signal v1 is amplified by the common-emitter circuit, and the amplified signal is input to an emitter follower composed of transistor Q12. The output current of the emitter follower is input through resistor R13 into the current mirror circuit composed of transistors Q13 and Q14. Output current I5 of said current mirror circuit is input to the transistor pair of transistor Q19 and npn transistor Q20. By selecting an appropriate gain for the common-emitter circuit, currents I5 and I6 generated in this way become independent of the base-emitter voltage, and performance is improved with respect to distortion characteristics.

5 Claims, 8 Drawing Sheets

MULTIPLIER

FIELD OF THE INVENTION

This invention pertains to a type of multiplier that performs multiplication to generate a signal as a product of two input signals.

BACKGROUND OF THE INVENTION

For example, the mixer circuit used in frequency converters and demodulators, etc. is often made of a circuit known as a Gilbert cell. The Gilbert cell is a circuit inverted by Mr. Barry Gilbert.

FIG. 8 is a schematic circuit diagram illustrating the basic constitution of said Gilbert cell.

In FIG. 8, Q1–Q6 represent npn transistors; CC1 represents a constant current circuit; R1 and R2 represent resistors; T1, T1', T2, T2', To and To' represent terminals.

The emitters of npn transistors Q1 and Q2 are connected to each other, and they are also connected to reference potential GND via constant current circuit CC1. The base of npn transistor Q1 is connected to terminal T1, and the base of npn transistor Q2 is connected to terminal T1'.

The emitters of npn transistors Q3 and Q4 are connected to each other, and, at the same time, they are also connected to the collector of npn transistor Q1. Also, the base of npn transistor Q3 is connected to terminal T2, and the base of npn transistor Q4 is connected to terminal T2'.

The emitters of npn transistors Q5 and Q6 are connected to each other, and, at the same time, they are also connected to the collector of npn transistor Q2. Also, the base of npn transistor Q5 is connected to terminal T2', and the base of npn transistor Q6 is connected to terminal T2.

The collectors of npn transistors Q3 and Q5 are connected to each other and to terminal To, and, at the same time, they are also connected through resistor R1 to power source Vcc.

The collectors of npn transistors Q4 and Q6 are connected to each other and to terminal To', and, at the same time, they are also connected through resistor R2 to power source Vcc.

Constant voltage V1 is input as an in-phase voltage to terminal T1 and terminal T1', and signal v1 is input to them as a differential voltage.

Constant voltage V2 is input as an in-phase voltage to terminal T2 and terminal T2', and signal v2 is input to them as a differential voltage.

In the Gilbert cell shown in FIG. 8 with said constitution, the following relationship is established between input differential voltages v1 and v2 and output differential voltage vo.

$$v_0 = v_{01} - v_{02} = \tanh\left(\frac{v_1}{2V_T}\right)\cdot\tanh\left(\frac{v_2}{2V_T}\right)\cdot I_0\cdot R_L \tag{1}$$

In Equation (1), RL represents the resistance values of resistors R1 and R2, and $V_T$ represents the thermal voltage of the npn transistor.

Thermal voltage $V_T$ is the following function of Boltzmann constant k, temperature T of the junction portion of the transistor, and electron charge q: VT=kT/q For example, assuming that the junction temperature T is 300K., it is about 26 mV.

First of all, in Equation (1), when input differential voltage v1 and input differential voltage v2 are much smaller than said thermal voltage $V_T$, that is, when $|v12V_T|<<1$ and $|v2/2V_T|<<1$, one has $$\tan h(v1/2V_T)\approx v1/2V_T$$

$$\tan h(v2/2V_T)\approx v2/2V_T$$

Consequently, Equation (1) can be approximately rewritten as follows.

$$v_0 = v_{01} - v_{02} = \left(\frac{v_1}{2V_T}\right)\cdot\left(\frac{v_2}{2V_T}\right)\cdot I_0\cdot R_L = \frac{I_0\cdot R_L}{4\cdot(V_T)^2}(v1\cdot v2) \tag{2}$$

As can be seen from Equation (2), output differential voltage vo is proportional to the product of input differential voltage v1 and input differential voltage v2, that is, the Gilbert cell shown in FIG. 8 functions as a multiplier.

Also, for the Gilbert cell shown in FIG. 8, usually, one of the input signals is a small signal, while the other input signal is a large signal. Consequently, consider the case when $|v12V_T|>>1$ and $|v2/2V_T|>>1$.

First of all, when $v2/2V_T>>1$, one has $$\tan h(v2/2V_T)\approx 1$$

Consequently, Equation (1) can be approximately rewritten as follows.

$$v_0 = \left(\frac{I_0\cdot R_L}{2V_T}\right)\cdot v_1$$

$$\text{When } v_2/2V_T>>-1 \tag{3},$$

$$\text{When } v_2/2V_T<<-1\text{, one has}$$

$$\tan h(v2/2V_T)\approx -1$$

Consequently, Equation (1) can be approximately rewritten as follows.

$$v_0 = -\left(\frac{I_0\cdot R_L}{2V_T}\right)\cdot v_1 \quad \frac{v_2}{2V_T} \ll -1\text{のとき} \tag{4}$$

$$\text{when } v_2/2V_T>>-1 \tag{4}.$$

As can be seen from Equations (3) and (4), the magnitude of output differential voltage vo is proportional to input differential voltage v1, and the sign of output differential voltage vo is inverted corresponding to the sign of input differential voltage v2. This is equivalent to multiplying output differential voltage vo with a value of "+1" or "−1", depending on the sign of input differential voltage v2. Consequently, even in this case, the Gilbert cell shown in FIG. 8 still functions as a multiplier.

However, for said Gilbert cell shown in FIG. 8, there are the following problems.

For the Gilbert cell shown in FIG. 8, for example, when constant current source CC1 is made of a conventional current mirror circuit, the maximum amplitude ΔVomax of the output signal that can be taken from terminal To or To' is as follows:

$$\Delta Vo\max \leqq Vcc - 3Vce$$

Here, Vce represents the collector-emitter voltage of the npn transistor. In order for the transistor to operate in a unsaturated state with high stability, said collector-emitter voltage Vce usually should be about 1 V. For example, assuming that power source Vcc=5 V, collector-emitter voltage Vcc=1 V, the maximum amplitude of the output signal, ΔVomax, becomes $$\Delta Vo\max \leqq 5-3\times 1=2\ (V)$$

Under the same condition, assuming that power source Vcc=3V, one has $$\Delta Vo\max \leqq 3-3\times 1=0\ (V)$$

Consequently, when power source Vcc=3 V, the Gilbert cell cannot operate with a high stability.

Consequently, for the Gilbert cell circuit shown in FIG. 8, stable operation cannot be realized as a low-voltage circuit with a power source voltage of 3 V or lower. This is a problem. On the other hand, in recent years, an ever increasing demand for lowering of the voltage for semiconductor integrated circuits has existed. Consequently, a demand exists for development of a type of multiplier that can operate at a power source voltage lower than that of said Gilbert cell circuit.

In the prior art, circuits shown in FIGS. 9 and 10 have been proposed as multipliers that can work under a low voltage.

FIG. 9 is a circuit diagram illustrating an example of a conventional multiplier that can work at a power source voltage lower than that of the Gilbert cell.

The same part numbers are used for FIGS. 8 and 9. Also, Q1' and Q2' represent pnp transistors, and CC2–CC4 represent constant current circuits.

For the multiplier shown in FIG. 9, instead of the differential amplifier composed of npn transistors Q1 Q2 and constant current circuit CC1 shown in FIG. 8, a differential amplifier composed of pnp transistors Q1', Q2' and constant current circuit CC4 is set.

That is, the emitters of pnp transistors Q1' and Q2'0 are connected to each other, and, at the same time, they are connected through constant current circuit CC4 to power source Vcc. The collector of pnp transistor Q1' is connected to the emitters of npn transistor Q3 and npn transistor Q4 that are connected to each other, and its base is connected to terminal T2. The collector of pnp transistor Q2' is connected to the emitters of npn transistors Q5 and Q6 that are connected to each other, and its base is connected to terminal T2'. Constant voltage V2 is input as an in-phase voltage to terminals T2 and T2', and signal v2 is input as a differential voltage to these terminals.

Also, the emitters of npn transistors Q3 and Q4 that are connected to each other are connected through constant current circuit CC2 to reference voltage GND. The emitters of npn transistors Q5 and Q6 that are connected to each other are connected through constant current circuit CC3 to reference potential GND.

For the multiplier shown in FIG. 9 with the aforementioned constitution, when conventional current mirror circuits are used to form constant current circuits CC2 and CC3, the maximum amplitude of the output signal, ΔVomax, becomes $$\Delta Vo\max \leqq Vcc-2Vce$$

The amplitude of the output signal is larger than that of the Gilbert cell shown in FIG. 8 by collector-emitter voltage Vce of one transistor. In other words, it can work with high stability at a power source voltage lower by this voltage than that needed for the Gilbert cell.

FIG. 10 is a circuit diagram illustrating another example of a conventional multiplier that can work at a power source voltage lower than that of the Gilbert cell.

The part numbers for FIG. 10 are the same as those for FIG. 9. Also, Q7 and Q8 represent npn transistors, CC7–CC9 represent constant current circuits, and CV1 and CV2 represent constant voltage circuits.

For the multiplier shown in FIG. 10, instead of the differential amplifier composed of pnp transistors Q1', Q2' and constant current circuit CC4 shown in FIG. 9, a differential amplifier composed of npn transistors Q7, Q8, and constant current circuits CC7–CC9 is set.

That is, the emitters of npn transistors Q7 and Q8 are connected to each other, and, at the same time, they are connected through constant current circuit CC7 to reference potential GND. The collector of npn transistor Q7 is connected through constant current circuit CC8 to power source Vcc, and its base is connected to terminal T2. The collector of npn transistor Q8 is connected through constant current circuit CC9 to power source Vcc, and its base is connected to terminal T2'. Constant voltage V2 is input as an in-phase voltage to terminals T2 and T2', and signal v2 is input as a differential voltage to these terminals.

Also, the collector of npn transistor Q7 is connected through constant voltage circuit CV1 to the emitters of npn transistors Q3 and Q4 that are connected to each other and also through constant current circuit CC8 to power source Vcc. The collector of npn transistor Q8 is connected through constant voltage circuit CV2 to the emitters of npn transistors Q5 and Q6 that are connected to each other and also through constant current circuit CC9 to power source Vcc.

For the multiplier shown in FIG. 10 with the aforementioned constitution, when conventional current mirror circuits are used to form constant current circuits CC2 and CC3, the maximum amplitude of the output signal, ΔVomax, becomes $$\Delta Vo\max \leqq Vcc-2Vce$$

The amplitude of the output signal is larger than that of the Gilbert cell shown in FIG. 8 by collector-emitter voltage Vce of one transistor. In other words, it can work with high stability at a power source voltage lower by this voltage than that needed for the Gilbert cell.

However, for the conventional low-voltage multipliers shown in FIGS. 9 and 10, there are the following problems.

For the multiplier shown in FIG. 9, it is necessary to use pnp transistors. Consequently, compared with the Gilbert cell that uses only npn transistors, the frequency characteristics are worse.

Also, for the multipliers shown in FIGS. 9 and 10, current sources have to be set on both the power source Vcc side and the reference potential GND side. Also, it is necessary for the two current values to be in agreement with each other at high precision. Consequently, a complex circuit has to be set. In addition, these multipliers have more constant current circuits and constant voltage circuits than the Gilbert cell shown in FIG. 8. Consequently, the circuit becomes complicated. This is undesired.

A general object of this invention is to solve the aforementioned problems of the conventional methods by providing a type of multiplier that has a constitution simpler than that of the prior art and can perform multiplication operation at a power source voltage lower than that of the Gilbert cell. Another general object of this invention is to provide a type of multiplier that can perform multiplication operation at a power source voltage lower than that of the Gilbert cell, without using pnp transistors.

SUMMARY OF THE INVENTION

This and other objects and features are attained according to one aspect of this invention by: a first current output circuit that has an input portion, which has one signal of a first differential signal applied on it, and a current output portion which outputs a first current corresponding to said one signal; a second current output circuit that has an input portion, which has the other signal of said first differential signal applied on it, and a current output portion which outputs a second current corresponding to said other signal; a first transistor pair that has a first transistor and a second transistor, on which a second differential signal is applied, and feeds said first current; a second transistor pair that has a third transistor and a fourth transistor, on which said second differential signal is applied, and feeds said second current; a first resistor for feeding current to said second transistor and third transistor; and a second resistor for feeding current to said first transistor and fourth transistor; a differential signal is output from the connecting node between said first resistor and said second and third transistor and the connecting node between said second resistor and said first transistor and fourth transistor.

Also, an aspect of this invention may have the following constitution: the input portion of said first current feeding circuit is connected to a second power source voltage, and it has a fifth transistor with said one signal applied on its base; and the input portion of said second current feeding circuit is connected to the second power source voltage, and it has a sixth transistor with said other signal applied on its base.

Also, an aspect of the invention can include said first current feeding circuit being connected to the first power source voltage, and it has a seventh transistor with the output signal of said fifth transistor applied on its base; and said second current feeding circuit is connected to the first power source voltage, and it has an eighth transistor with the output signal of said sixth transistor applied on its base.

Also, an aspect of this invention may have the following constitution: said first current feeding circuit has a first current mirror circuit composed of a ninth transistor connected to said seventh transistor and a tenth transistor connected to said first transistor pair; and said second current feeding circuit has a second current mirror circuit composed of an eleventh transistor connected to said eighth transistor and a twelfth transistor connected to said second transistor pair.

In addition, an aspect of the invention may have a third resistor connected between said seventh transistor and said ninth transistor, and a fourth resistor connected between said eighth transistor and said eleventh transistor.

REFERENCE NUMERALS AND SYMBOLS AS SHOWN IN THE DRAWINGS

In the figures, Q1–Q28 represent npn transistors, Q1'–Q4' pnp transistors, C1–C9 constant current circuits, R1–R32 resistor, T1, T1', T2, T2', To, To' terminals, CV1, CV2 constant voltage circuits.

DESCRIPTION OF THE EMBODIMENT

In the following, an embodiment of this invention will be considered with reference to FIGS. 1–7.

Figure 1:
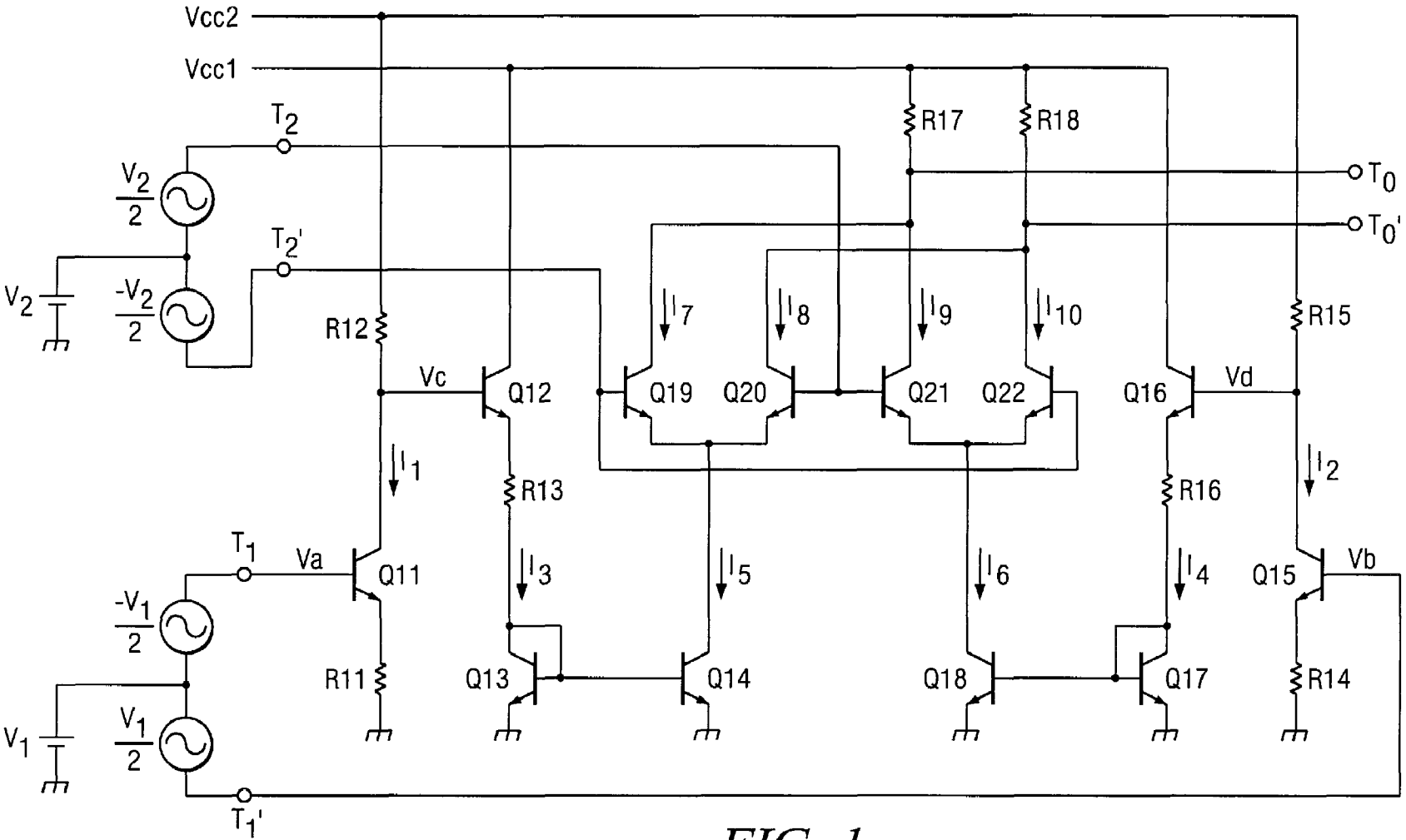
FIG. 1 is a schematic circuit diagram illustrating an example of constitution of a multiplier in an embodiment of this invention.

FIG. 1 is a schematic circuit diagram illustrating an example of a multiplier in an embodiment of this invention.

FIG. 1, Q11–Q22 represent npn transistors, R11–R18 represent resistors, and T1, T1', T2, T2', To and To' represent terminals.

The emitters of npn transistor Q19 and npn transistor Q20 are both connected to the collector of npn transistor Q14. The emitters of npn transistors Q21 and Q22 are both connected to the collector of npn transistor Q18.

The bases of npn transistors Q20 and Q21 are both connected to terminal T2. The bases of npn transistors Q19 and Q22 are both connected to terminal T2'.

The collectors of npn transistors Q19 and Q21 are both connected to terminal To, and the connection node is connected through resistor R17 to power source Vcc1. The collectors of npn transistors Q20 and Q22 are both connected to terminal To', and the connection node is connected through resistor R18 to power source Vcc1.

For npn transistor Q11, its base is connected to terminal T1, its emitter is connected through resistor R11 to reference potential GND, and its collector is connected through resistor R12 to power source Vcc2.

For npn transistor Q12, its base is connected to the collector of npn transistor Q11, and its collector is connected to power source Vcc1.

The bases of npn transistors Q13 and Q14 are connected to each other, and their emitters are both connected to reference potential GND. Also, the collector of npn transistor Q13 is connected to its own base and is connected through resistor R13 to the emitter of npn transistor Q12.

For npn transistor Q15, its base is connected to terminal T1', its emitter is connected through resistor R14 to reference potential GND, and its collector is connected through resistor R15 to power source Vcc2.

For npn transistor Q16, its base is connected to the collector of npn transistor Q15, and its collector is connected to power source Vcc1.

The bases of npn transistors Q17 and Q18 are connected to each other, and their emitters are both connected to reference potential GND. Also, the collector of npn transistor Q17 is connected to its own base and is connected through resistor R16 to the emitter of npn transistor Q16.

Constant voltage V1 is input as an in-phase voltage to terminals T1 and T1', and signal v1 is input as a differential signal to said terminals.

Constant voltage V2 is input as an in-phase voltage to terminals T2 and T2', and signal v2 is input as a differential signal to said terminals.

In the multiplier shown in FIG. 1, npn transistor Q11, and resistors R11 and R12 form a common-emitter circuit. By means of this common-emitter circuit, one signal of said differential signal v1 is amplified, and it is input to an emitter follower consisting of npn transistor Q2. The output current from the emitter follower is input through resistor R13 to a current mirror circuit consisting of npn transistors Q13 and Q14. The output current of this current mirror circuit is input to the connected common emitters of the transistor pair of npn transistors Q19 and Q20.

Similarly, npn transistor Q15, and resistors R14 and R15 form a common-emitter circuit. By means of this common-emitter circuit, the other signal of said differential signal v1 is amplified, and it is input to an emitter follower consisting of npn transistor Q16. The output current from the emitter follower is input through resistor R16 to a current mirror circuit consisting of npn transistors Q17 and Q18. The output current of this current mirror circuit is input to the connected common emitters of the transistor pair consisting of npn transistors Q21 and Q22.

In the following, the function of multiplication of the multiplier with said constitution shown in FIG. 1 will be considered.

In the following description, it is assumed that npn transistors Q11–Q18 have the same size, and the base current of the transistors is negligibly small. Based on this assumption, one can assume that the DC bias currents of npn transistors Q12–Q14 as well as npn transistors Q16–Q18 are all the same.

Also, by selecting appropriate values for power source Vcc2, resistor R11, resistor R14, and DC bias voltage V1, the DC bias current of npn transistor Q11 and npn transistor Q15 can be made equal to that of npn transistors Q12–Q14 as well as npn transistors Q16–Q18.

In the following explanation, it is assumed that the base-emitter voltages of npn transistors Q11–Q18 are all equal with the same voltage $V_{BE}$.

Also, the aforementioned conditions are only for simplifying explanation of this invention. They are not necessary conditions for this invention.

Collector current I1 of npn transistor Q11 can be represented as the following function of resistance $R_E$ of resistor R11 and base voltage Va of npn transistor Q11.

$$I_1 = \frac{V_a - V_{BE}}{R_E} \tag{5}$$

Assuming that resistor R14 has the same resistance $R_E$ as that of resistor R11, collector current I2 of npn transistor Q15 can be represented by the following formula as a function of said resistance $R_E$ and base voltage Vb of npn transistor Q15.

$$I_2 = \frac{V_b - V_{BE}}{R_E} \tag{6}$$

Assuming that resistor R12 has a resistance of $R_C$, collector voltage Vc of npn transistor Q11 can be represented by the following formula.

$$V_c = V_{CC2} - I_1 \cdot R_C = V_{CC2} - \frac{R_C}{R_E}(V_a - V_{BE}) \tag{7}$$

Also, assuming that resistor R15 has the same resistance $R_C$ as resistor R12, collector voltage Vd of npn transistor Q15 can be represented by the following formula.

$$V_d = V_{CC2} - I_2 \cdot R_C = V_{CC2} - \frac{R_C}{R_E}(V_b - V_{BE}) \tag{8}$$

Due to the current mirror circuit consisting of npn transistors Q13 and npn transistor Q14, emitter current I3 of npn transistor Q12 and collector current I5 of npn transistor Q14 are equal to each other, and they can be represented by the following equation using voltage Vc of Equation (7).

$$I_3 = I_5 = \frac{V_C - 2 \cdot V_{BE}}{R} = \frac{V_{CC2} - \frac{R_C}{R_E}(V_a - V_{BE}) - 2 \cdot V_{BE}}{R} \tag{9}$$

Here, R represents the resistance of resistors R13 and R16.

Similarly, due to the current mirror circuit consisting of npn transistors Q17 and Q18, emitter current I4 of npn transistor Q16 and collector current I6 of npn transistor Q18 are equal to each other, and they can be represented by the following equation using voltage Vd of Equation (8).

$$I_4 - I_6 = \frac{V_d - 2 \cdot V_{BE}}{R} = \frac{V_{CC2} - \frac{R_C}{R_E}(V_b - V_{BE}) - 2 \cdot V_{BE}}{R} \tag{10}$$

Here, when the resistance values of resistors R11, R12, R14 and R15 are selected such that the following relationship is established $$R_C/R_E = 2$$

Equations (9) and (10) become as follows.

$$I_3 = I_5 = \frac{V_{CC2} - 2 \cdot (V_a - V_{BE}) - 2 \cdot V_{BE}}{R} = \frac{V_{CC2} - 2 \cdot V_a}{R} \tag{11}$$

$$I_4 = I_6 = \frac{V_{CC2} - \frac{R_C}{R_E}(V_b - V_{BE}) - 2 \cdot V_{BE}}{R} = \frac{V_{CC2} - 2 \cdot V_b}{R} \tag{12}$$

As can be seen from Equations (11) and (12), currents I3–I5 do not depend on base-emitter voltage $V_{BE}$ of the transistor.

Also, collector current currents I7–I10 of npn transistors Q19–Q22 can be represented by the following equations as functions of the output current of the current mirror circuit (current I5 or current I6), differential voltage v2 and thermal voltage $V_T$.

$$I_7 = \frac{I_5}{1 + \exp\left(-\frac{v_2}{V_T}\right)} \tag{13}$$

$$I_8 = \frac{I_5}{1 + \exp\left(\frac{v_2}{V_T}\right)} \tag{14}$$

$$I_9 = \frac{I_6}{1 + \exp\left(\frac{v_2}{V_T}\right)} \tag{15}$$

$$I_{10} = \frac{I_6}{1 + \exp\left(-\frac{v_2}{V_T}\right)} \tag{16}$$

Consequently, current ΔI as a difference between the current of resistor R17 and the current of resistor R18 can be represented by the following equation.

$$\begin{aligned} \Delta I = I_7 - I_8 + I_9 - I_{10} &= \frac{\exp\left(\frac{v_2}{V_T}\right) - \exp\left(\frac{v_2}{V_T}\right)}{\left[1 + \exp\left(\frac{v_2}{V_T}\right)\right]\left[1 + \exp\left(-\frac{v_2}{V_T}\right)\right]}(I_5 - I_6) \\ &= \tanh\left(\frac{v_2}{2 \cdot V_T}\right) \cdot (I_5 - I_6) \\ &= \tanh\left(\frac{v_2}{2 \cdot V_T}\right) \cdot \frac{2}{R} \cdot (V_b - V_a) = \tanh\left(\frac{v_2}{2 \cdot V_T}\right) \cdot \frac{2}{R} \cdot v_1 \end{aligned} \tag{17}$$

Where, v1=Vb−Va.

Because Equation (17) represents the differential current flowing in the load resistor, by multiplying it with the resistance value RL of resistors R17 and R18, one can obtain the differential voltage vo between terminal To and terminal To'.

$$v_0 = RL \times \Delta I = \tanh\left(\frac{v_2}{2 \cdot V_T}\right) \cdot \frac{2RL}{R} \cdot v_1 \tag{18}$$

Consider the case when input differential voltage v2 is much smaller than said thermal voltage $V_T$, that is, when $|v2/2V_T| \ll 1$. In this case, as explained above, one has $$\tan h(v2/2V_T) \approx v2/2V_T$$

Consequently, Equation (18) can be changed approximately to the following form.

$$v_0 = \frac{RL}{V_T \cdot R} \cdot (v_1 \cdot v_2) \tag{19}$$

As can be seen from Equation (19), output differential voltage vo is proportional to the result of multiplication between input differential voltage v1 and input differential voltage v2, and the circuit shown in FIG. 1 functions as a multiplier.

Also, consider the case when input differential signal v1 is a small signal, while the input differential signal v2 is a large signal ($|V2/2V_T| \gg 1$).

When $|V2/2V_T| \gg 1$, one has $$\tan h(v2/2V_T) \approx 1$$

when $V2/2V_T \ll -1$, one has $$\tan h(v2/2V_T) \approx -1$$

Consequently, the following approximation can be used for the Equation (18).

$$v_0 = \frac{2RL}{R} \cdot v_1$$

when $V2/2V_T \gg 1$.

$$v_0 = -\frac{2RL}{R} \cdot v_1$$

when $V2/2V_T \ll -1$.

As can be seen from Equations (20) and (21), the magnitude of output differential voltage vo is proportional to input differential voltage v1, and the sign of output differential voltage vo is inverted corresponding to the sign of input differential voltage v2. This is equivalent to multiplying output differential voltage vo with a value of "+1" or "−1", depending on the sign of input differential voltage v2. Consequently, even in this case, the circuit in FIG. 1 still functions as a multiplier.

Figure 8:
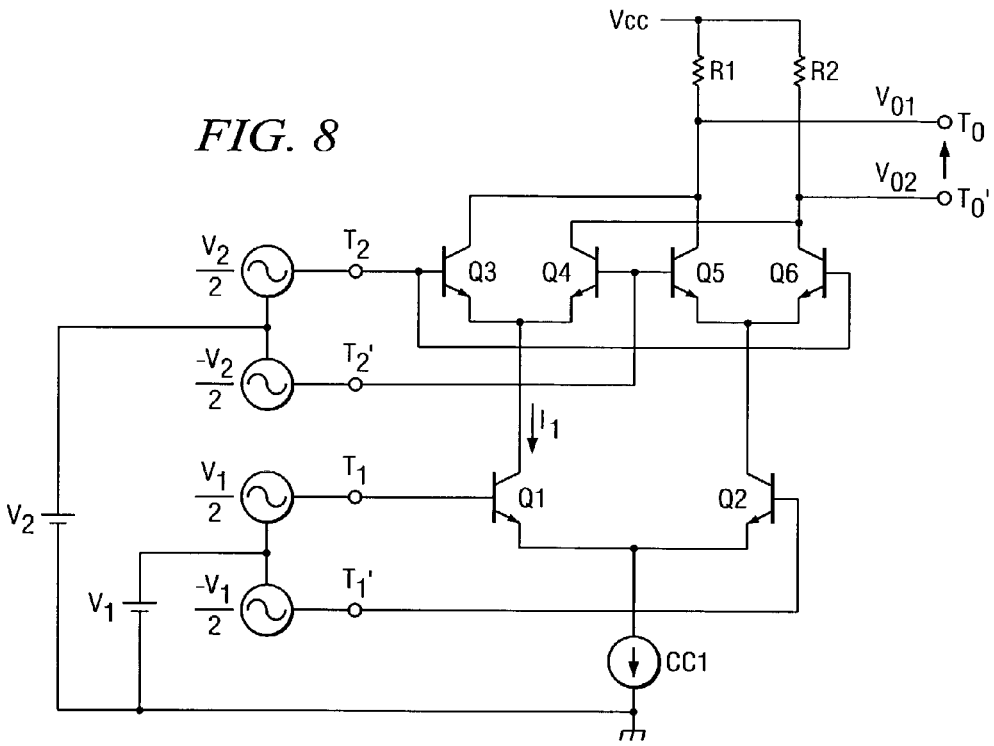
FIG. 8 is a schematic circuit diagram illustrating the basic constitution of a Gilbert cell.

Also, for the multiplier shown in FIG. 1, the maximum amplitude ΔVomax of the signal that can be output to output terminal To and output terminal To' becomes $$\Delta Vo\max \leqq Vcc1 - 2Vce$$

and the amplitude of the output signal is larger than that of the Gilbert cell shown in FIG. 8 by collector-emitter voltage Vce of one transistor. That is, it can perform stable operation at a power source voltage lower by said voltage than that of the Gilbert cell.

Also, the multiplier shown in FIG. 1 does not use pnp transistors. Consequently, the frequency characteristics are better than those of the multiplier shown in FIG. 9.

Figure 9:
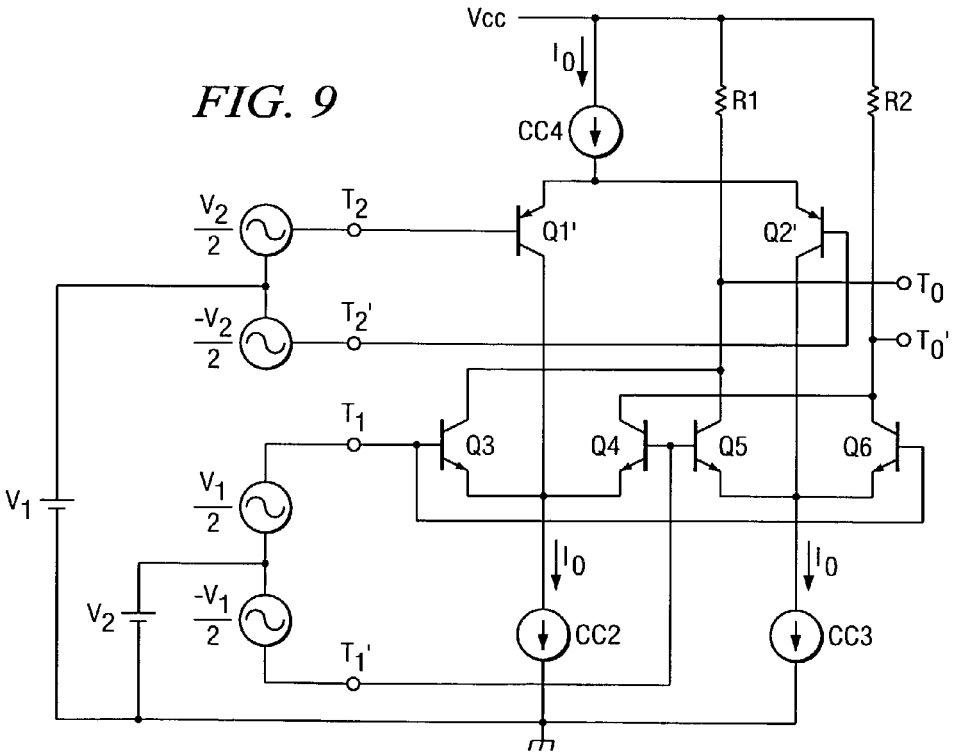
FIG. 9 is a circuit diagram illustrating an example of a conventional multiplier that can work at a power source voltage lower than that of the Gilbert cell.
Figure 10:
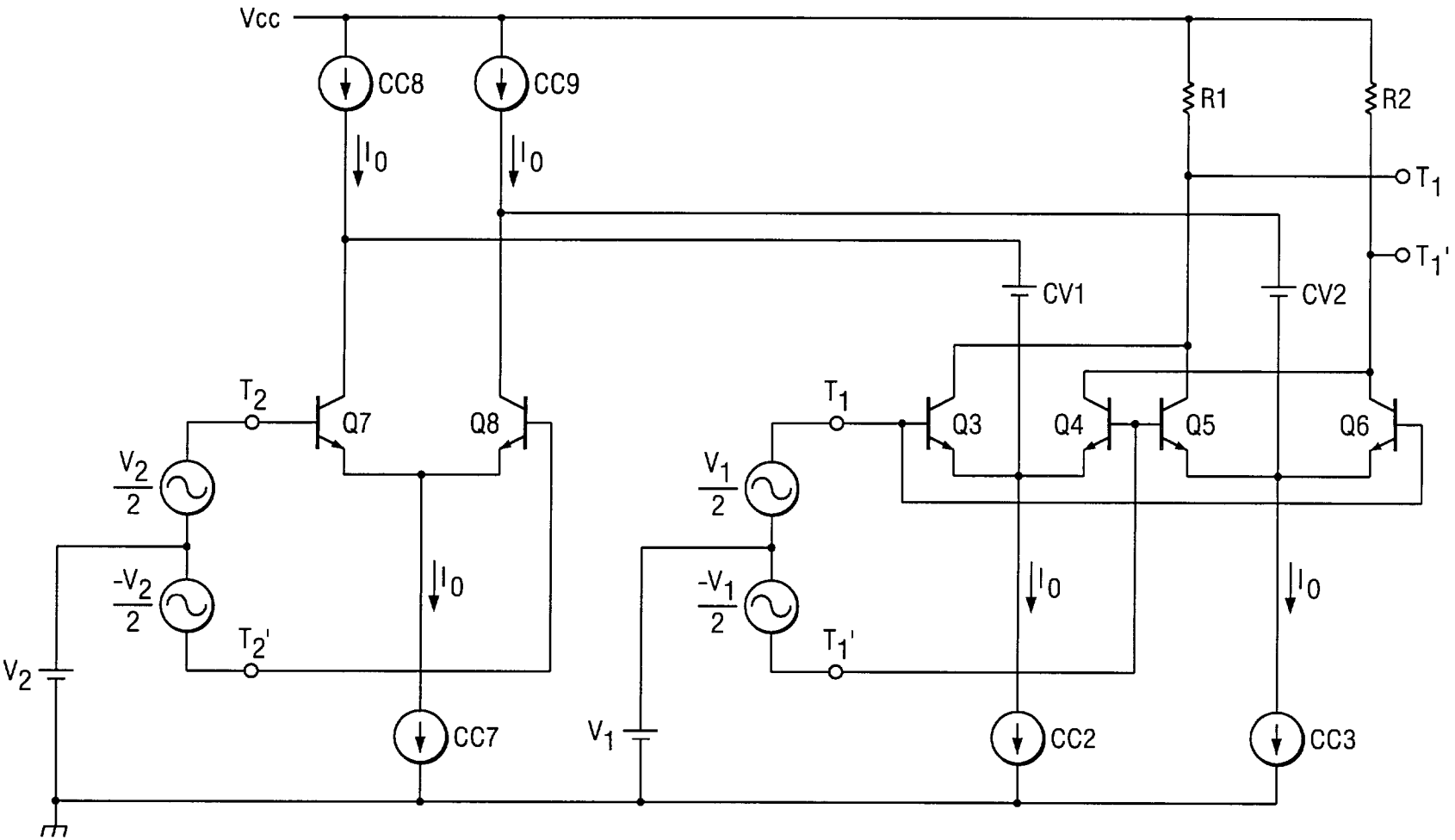
FIG. 10 is a circuit diagram illustrating another example of a conventional multiplier that can work at a power source voltage lower than that of the Gilbert cell.

In addition, in the multiplier shown in FIG. 1, there is no complicated circuit such as that in the multipliers shown in FIGS. 9 and 10 for ensuring that the currents in the constant current circuits connected to the power source side and those connected to the reference potential side are in agreement with each other at high precision. Instead, it has a simple constitution composed of conventional current mirror circuits, emitter followers, and common-emitter circuits.

Also, as can be seen from Equations (17) and (18), output differential voltage ΔI and output differential voltage vo are independent of base-emitter voltage $V_{BE}$ that varies as a function of collector current and temperature. Consequently, the multiplier shown in FIG. 1 has good performance with respect to distortion characteristics and temperature characteristics.

Also, because the DC bias components of currents I1–I4 are constant and independent of the amplitude of the input signals, these currents lead to a decrease in current use efficiency. However, based on the characteristics of a current mirror circuit, by adjusting the size of transistors, one can easily obtain currents I3 and I4 that are smaller than a fraction of currents I5 and I6. As a result, one can lower the current use efficiency of the multiplier shown in FIG. 1 to a low level similar to that of the Gilbert cell.

In addition, in Equation (1) for the Gilbert cell circuit shown in FIG. 8, hyperbolic function tan h occurs in both the input differential voltage v1 item and the input differential voltage v2 item. On the other hand, in Equation (18) of the multiplier shown in FIG. 1, only the input differential voltage v2 item has hyperbolic function tan h, while the input differential voltage v1 item is proportional to output differential voltage vo. As explained above, hyperbolic function tan h can be approximately represented as a linear function over a small range, yet it becomes a nonlinear function when the variable occupies a larger range. Consequently, the nonlinearity of the hyperbolic function becomes a cause for distortion in output differential voltage vo. Consequently, it is believed that the multiplier shown in FIG. 1 is better than the Gilbert cell circuit shown in FIG. 8 with respect to distortion characteristics and input dynamic range.

In the following, other constitution embodiments of this invention will be considered.

Figure 2:
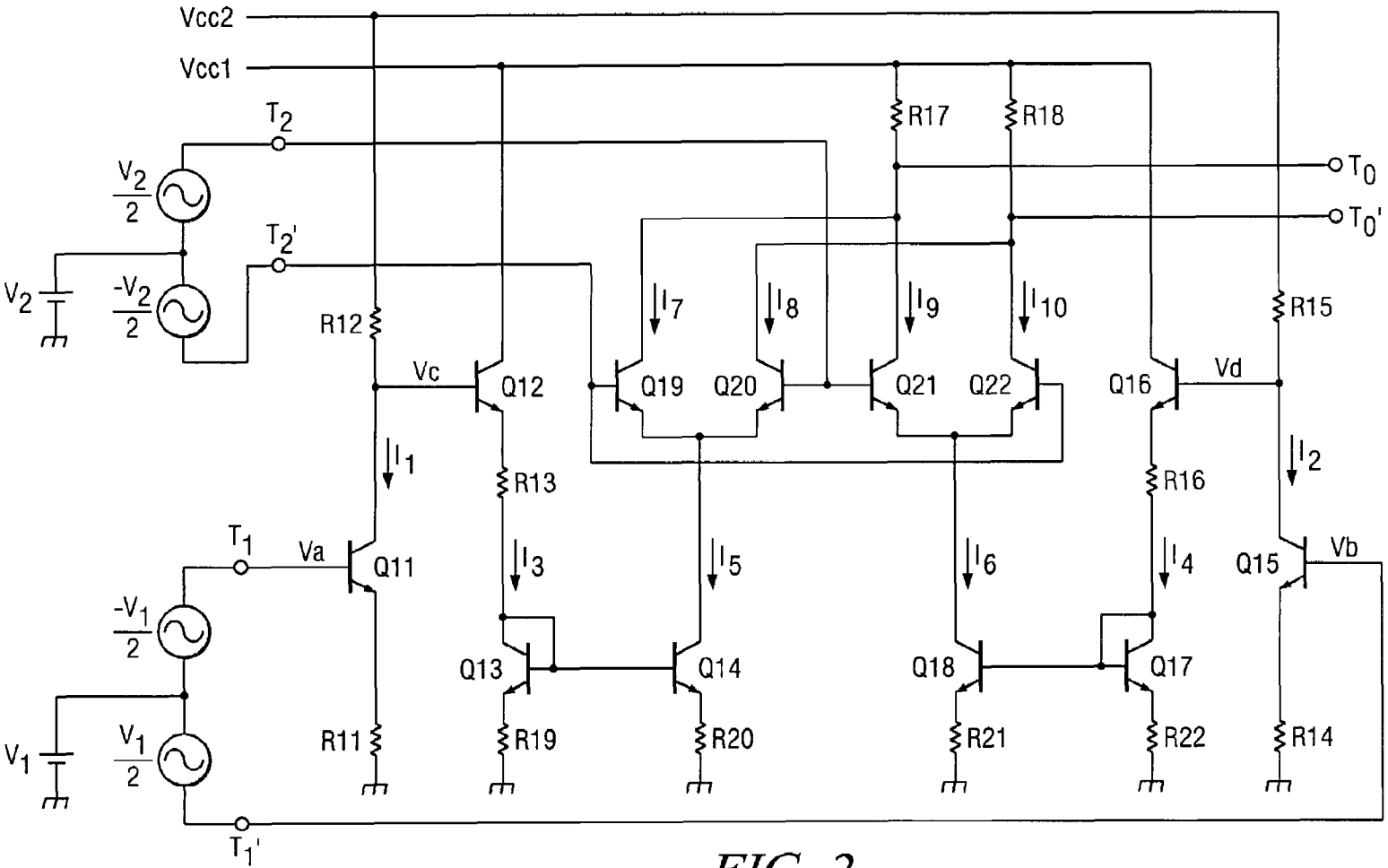
FIG. 2 is a schematic circuit diagram illustrating an example in which resistors are inserted between emitters of transistors that form current mirror circuits in FIG. 1 and the reference potential, respectively.

FIG. 2 is a schematic diagram illustrating an example in which resistors are inserted between emitters of transistors that form a current mirror circuit and reference potential GND, respectively, in the multiplier shown in FIG. 1. The same part numbers are used for FIGS. 1 and 2.

In the multiplier shown in FIG. 2, the emitters of npn transistors Q13, Q14, Q18, and Q17 are connected through resistors R19–R22 to reference potential GND, respectively.

In this way, by inserting resistors at the emitter side, of transistors so as to increase the precision of the current mirror circuit, it is possible to improve performance with respect to distortion characteristics and temperature stability.

Figure 3:
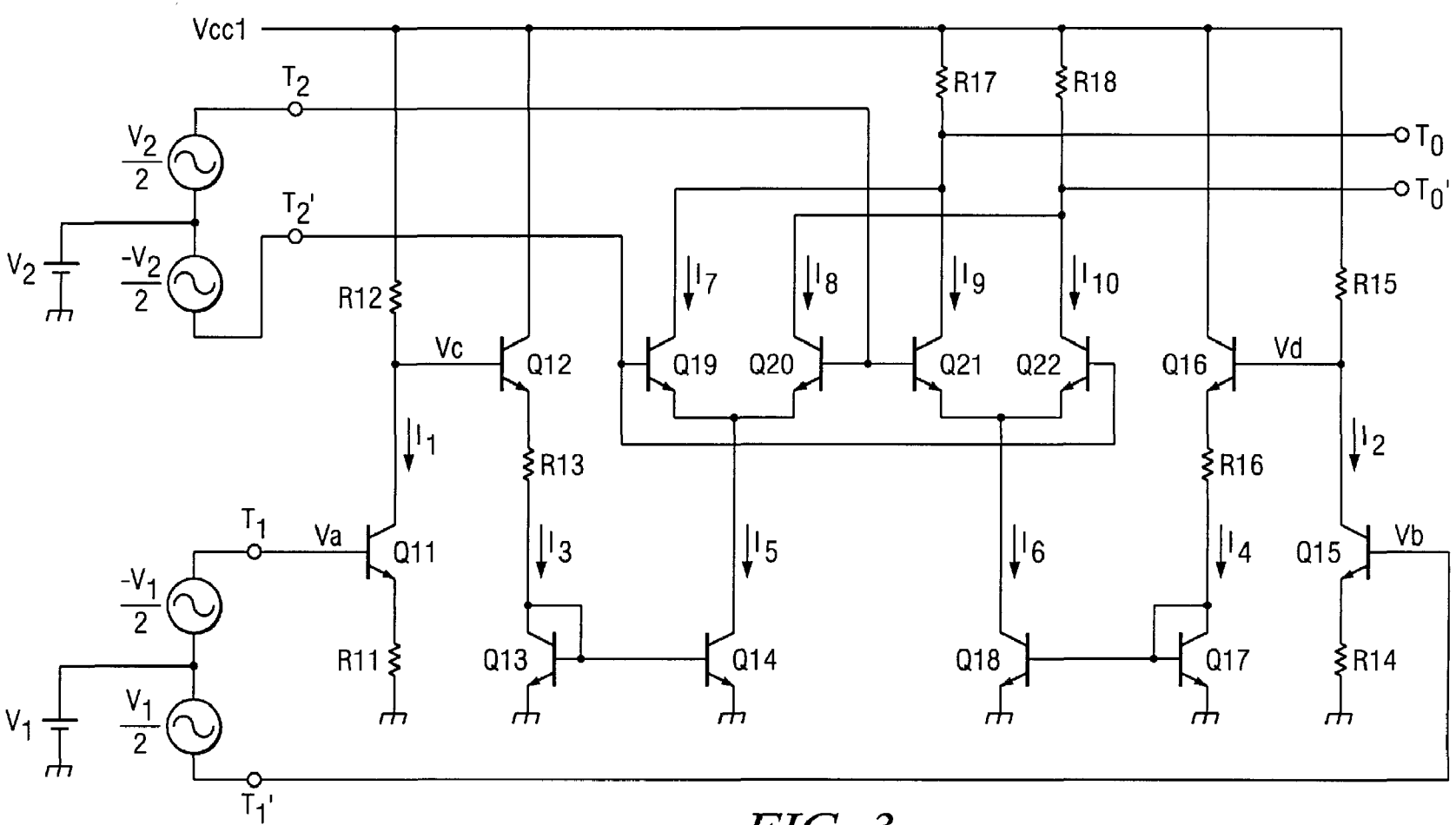
FIG. 3 is a schematic circuit diagram illustrating an example in the case when a single power source is shared as two power sources in FIG. 1.

FIG. 3 is a schematic circuit diagram illustrating an example in which power source Vcc2 and power source Vcc1 are combined in the multiplier shown in FIG. 1. The part numbers in FIG. 3 are the same as those in FIG. 1.

For the multiplier shown in FIG. 3, instead of adjustment of power source Vcc2, the size and base bias voltage V1 are selected appropriately for npn transistors Q11 and Q15, so that it is possible to eliminate the influence of base-emitter voltage $V_{BE}$ on differential output current ΔI and differential output voltage vo.

Figure 4:
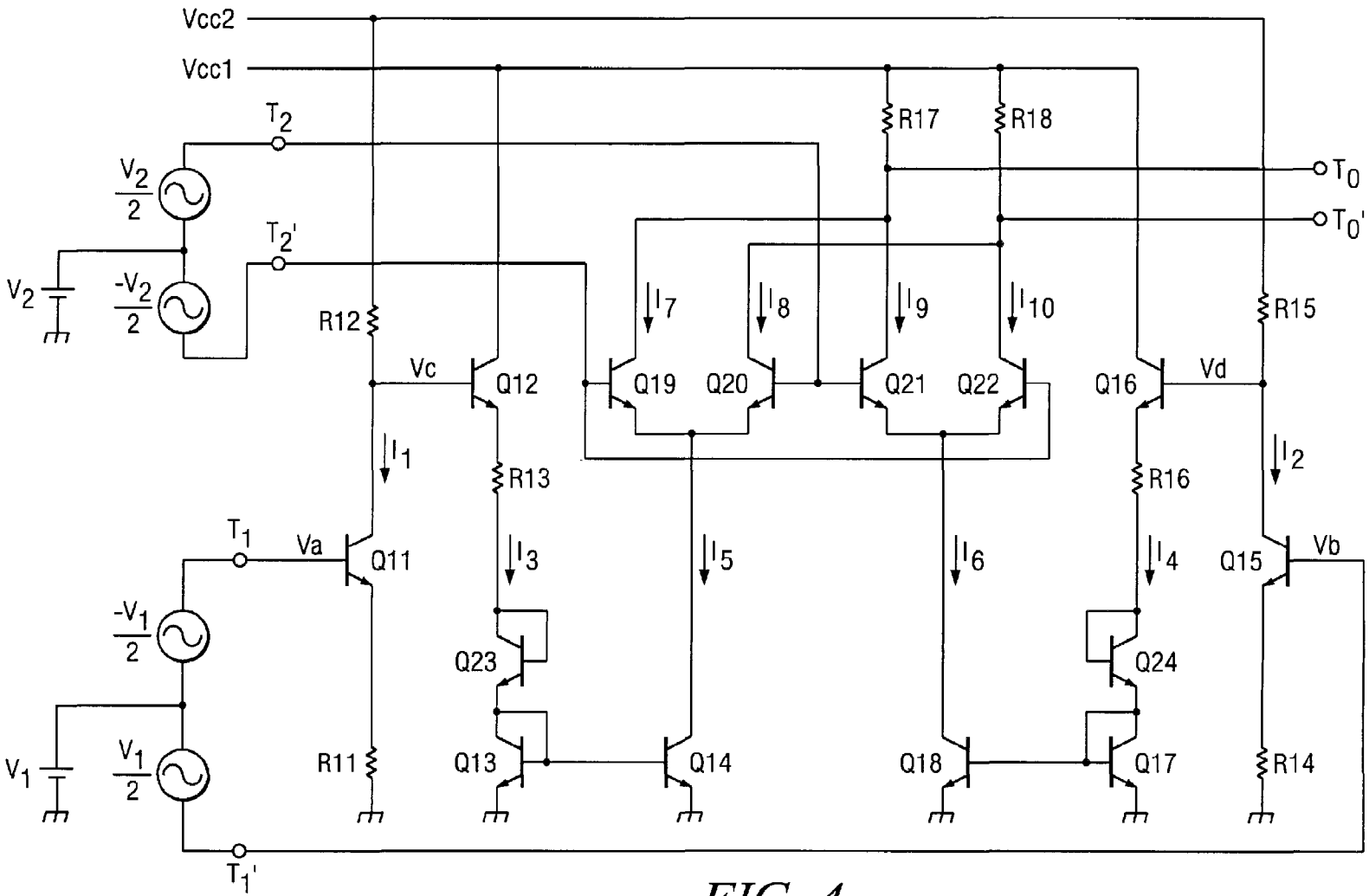
FIG. 4 is a schematic circuit diagram illustrating an example in the case when diodes are inserted on the connecting lines between emitter followers and current mirror circuits shown in FIG. 1.

FIG. 4 is a schematic circuit diagram illustrating an example in which a diode is inserted on the connecting line between the emitter followers and the current mirror circuits in the multiplier shown in FIG. 1. The part numbers in FIG. 4 are the same as those in FIG. 1.

For the multiplier shown in FIG. 4, a diode made of npn transistor Q23 having its base and collector connected to each other is inserted in series with respect to resistor R13. Also, a diode made of npn transistor Q24 having its base and collector connected to each other is inserted in series with respect to resistor R16.

As shown in FIG. 4, when n (n is a natural number) diodes are inserted on the connecting lines between emitter followers and current mirror circuits, appropriate resistance values are selected for resistors R11, R12, R14 and R15 so that the following relationship is met:

$$R_C/R_E=2+n$$

One can thus eliminate the influence of base-emitter voltage $V_{BE}$ on differential output current ΔI and differential output voltage vo.

Also, since resistance ratio ($R_C/R_E$) corresponds to the gain of the common-emitter circuit, as shown in FIG. 4, insertion of diodes leads to a increase in the gain. As a result, it is possible to reduce the noise figure.

In the example shown in FIG. 4, transistors having the base and collector connected to each other are used as diodes. However, one may also use other types of diodes, such as pn-junction diodes. Also, the position for insertion of diodes is not limited to that shown in the example of FIG. 4. For example, it may be on the connecting line between the emitter follower and current mirror circuit.

In the following, consider a simulation example of the multiplier shown in FIG. 3.

Figure 5:
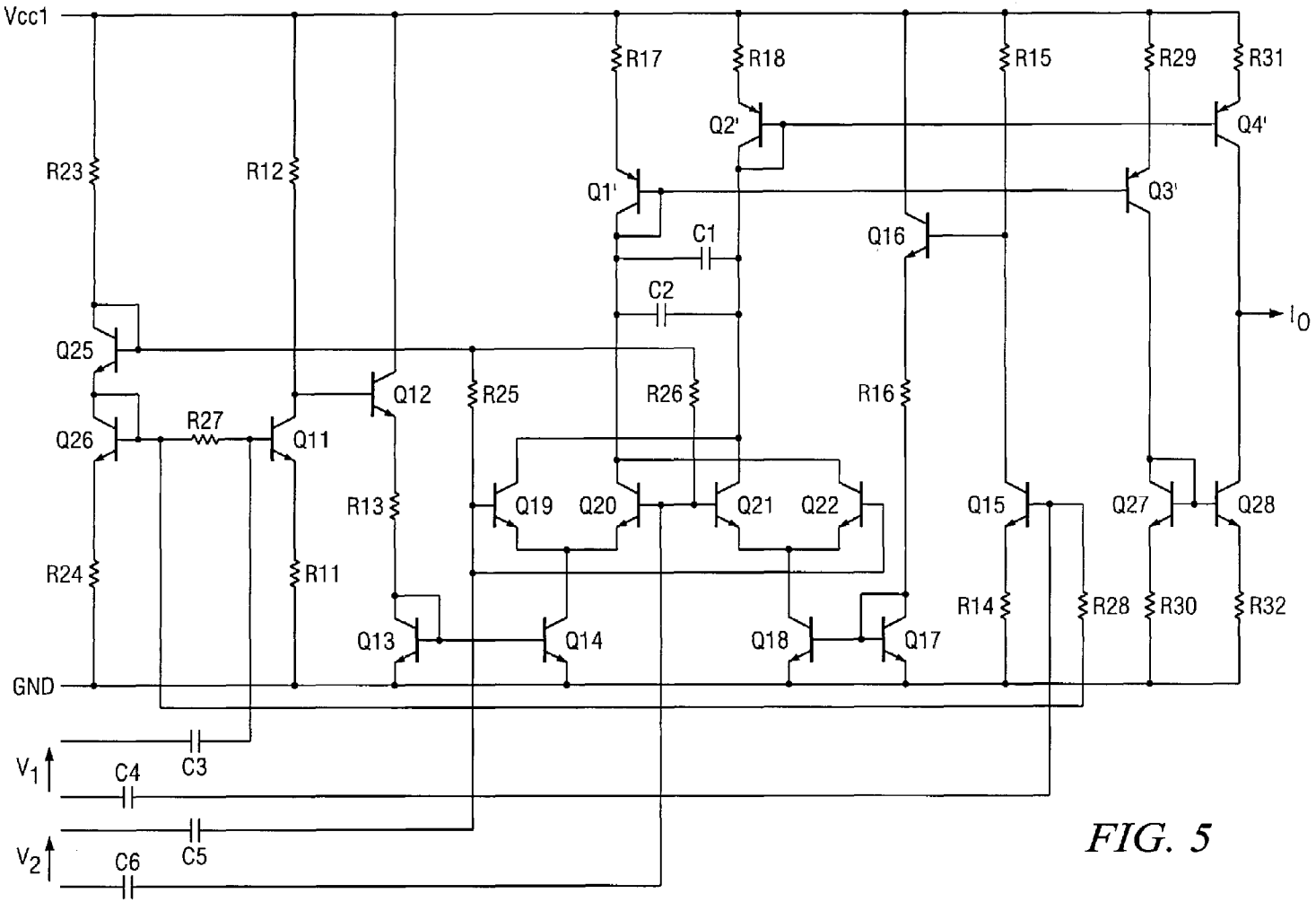
FIG. 5 is a diagram illustrating a simulation circuit.

FIG. 5 is a diagram illustrating the circuit for performing the simulation. The part numbers in FIG. 5 are the same as those in FIG. 3.

Also, in FIG. 5, Q25–Q28 represent npn transistors, Q1'–Q4' represent pnp transistors, R23–R32 represent resistors, and C1–C6 represent capacitors.

In the simulation circuit shown in FIG. 5, a bias circuit is composed of npn transistor Q25, Q26, and resistors R23–R28. This bias circuit supplies DC bias voltages on the bases of npn transistors Q11, Q15, and Q19–Q22.

That is, the collector of npn transistor Q25 is connected through resistor R23 to power source Vcc1, and its base is connected to its collector. For npn transistor Q26, its collector is connected to the emitter of npn transistor Q25, its base is connected to its own collector, and its emitter is connected through resistor R24 to reference potential GND. The base of npn transistor Q25 is connected through resistor R25 to the bases of npn transistors Q19 and Q22, and, at the same time, it is connected through resistor R26 to the bases of npn transistors Q20 and Q21. The base of npn transistor Q26 is connected through resistor R27 to the base of npn transistor Q11, and, at the same time, it is connected through resistor R28 to the base of npn transistor Q15.

In the simulation circuit shown in FIG. 5, pnp transistors Q1' and Q3' as well as Q2' and Q4' form current mirror circuits, respectively. Also, npn transistors Q27 and Q28 that receive the output currents from them also form a current mirror circuit.

That is, for pnp transistors Q1' and Q3', their bases are connected to each other, and their emitters are connected through resistors R17 and R29 to power source Vcc1. The collector of pnp transistor Q1' is connected to its own base, and it is also connected to the collector of npn transistor Q20. The collector of pnp transistor Q3' is connected to the collector of npn transistor Q27. For pnp transistors Q2' and Q4', their bases are connected to each other, and their emitters are connected through resistors R18 and R31 to power source Vcc1. The collector of pnp transistor Q2' is connected to its own base, and, at the same time, it is connected to the collector of npn transistor Q21. The collector of pnp transistor Q4' is connected to the collector of npn transistor Q28. For npn transistors Q27 and Q28, their bases are connected to each other, and their emitters are connected through resistors R30 and R32 to reference potential GND. The collector of npn transistor Q27 is connected to its own base.

For the aforementioned constitution, the difference between the current in resistor R17 and the current in resistor R18 is output as current difference Io between the collector current of pnp transistor Q4' and the collector current of npn transistor Q28.

Differential voltage v1 is input through capacitors C3 and C4 between the bases of npn transistors Q11 and Q15, and differential voltage v2 is input through capacitors C5 and C6 between bases of npn transistors Q19 and Q20. Capacitors C1 and C2 are connected in parallel in between the collectors of pnp transistors Q1' and Q2'.

Figure 6:
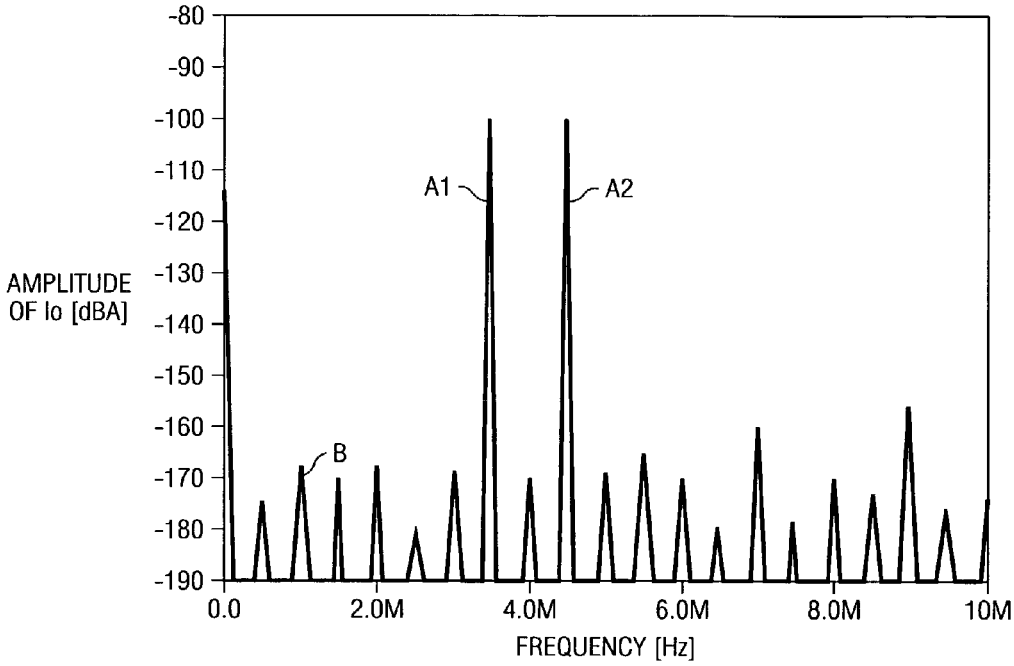
FIG. 6 is a diagram illustrating the results of simulation of the frequency component of the output signal when the power source voltage is set at 3 V in the circuit of FIG. 5.

FIG. 6 is a diagram illustrating the results of simulation of the frequency component of the output signal when power source voltage Vcc1 is set at 3V in the circuit shown in FIG. 5.

In FIG. 6, the abscissa represents frequency, and the ordinate represents amplitude of output current Io in units of dB, with 0 dBA corresponding to 0 A.

Also, in this simulation example, resistance $R_E$ of resistors R11 and R14 is set at 5 kΩ, resistance $R_C$ of resistors R12 and R15 is set at 10 kΩ, and resistance R of resistors R13 and R16 is set at 3 kΩ.

In FIG. 6, peaks A1 and A2 indicate the fundamental wave components of input differential signals v1 and v2, respectively. The frequency of peak A1 is 3.5 MHz, and the frequency of peak A2 is 4.5 MHz. In FIG. 6, peak B indicates the distortion wave component generated at the frequency (1 MHz) corresponding to the difference in frequency between input differential signals v1 and v2. When the fundamental wave component of peak A1 is taken as reference (0 dB), the magnitude of the distortion wave component of peak B becomes about −67 dB.

Figure 7:
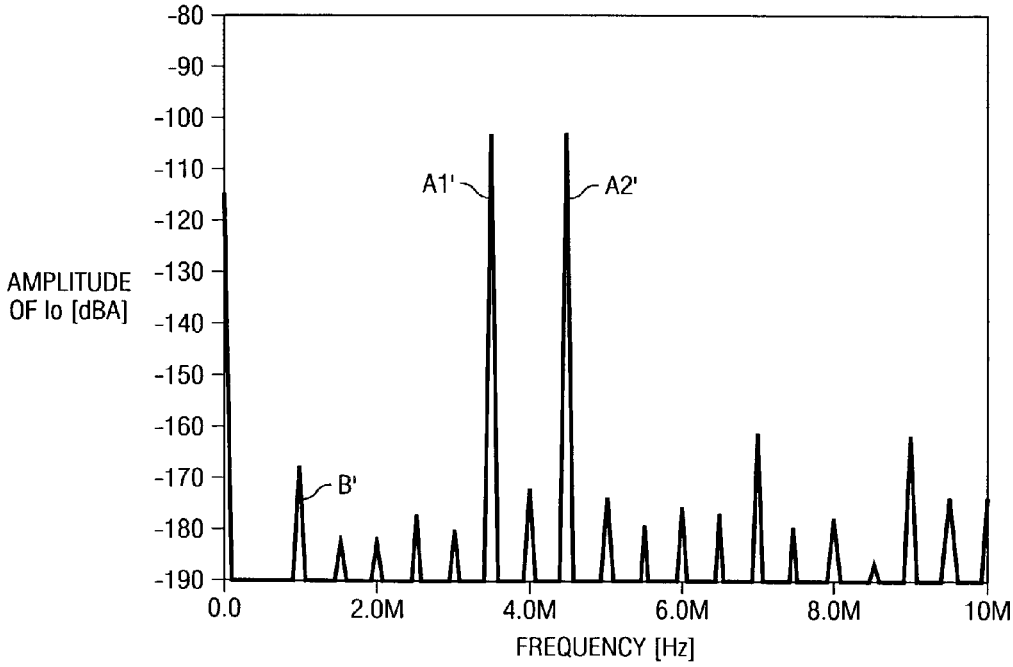
FIG. 7 is a diagram illustrating the results of simulation of the frequency component of the output signal when the power source voltage is set at 5V in the Gilbert cell shown in FIG. 8.

On the other hand, FIG. 7 is a diagram illustrating the results of simulation of the frequency component of the output signal when the power source voltage Vcc is set at 5 V for the Gilbert cell shown in FIG. 8.

Just as in FIG. 6, in FIG. 7, peaks A1' and A2' indicate the fundamental wave components of input differential signals v1 and v20, respectively, and peak B' represents the distortion component. When the fundamental wave component of peak A1' is taken as reference, the magnitude of the distortion wave component of peak B' becomes about −65 dB. The distortion component is only a little (about 2 dB) higher than that of the multiplier shown in FIG. 5.

As can be seen from these results of simulation, the multiplier shown in FIG. 5 has distortion characteristics equal to, or better than, those of the Gilbert cell.

As explained above, for the multiplier shown in FIG. 1, a common-emitter circuit is formed from npn transistor Q11, for which the emitter is connected through resistor R11 to reference potential GND and the collector is connected through resistor R12 to power source Vcc2. One voltage of differential voltage v1 input to its base is amplified at a gain corresponding to the ratio of emitter resistor R11 to collector resistor R12, and the amplified voltage is output from the collector. Also, an emitter follower is formed from npn transistor Q12, for which the collector is connected to power source Vcc1. The collector voltage of npn transistor Q11 is input to its base. The output current of the emitter follower is input through resistor R13 to a current mirror circuit composed of npn transistors Q13 and Q14. Output current I5 of the current mirror circuit is input to the connected common emitters of the first transistor pair composed of npn transistors Q19 and Q20. Differential voltage v2 is input to the pair of bases of said first transistor pair.

Similarly, a common-emitter circuit is formed from npn transistor Q15, for which the emitter is connected through resistor R14 to reference potential GND and the collector is connected through resistor R15 to power source Vcc2. The other voltage of differential voltage v1 input to its base is amplified at a gain corresponding to the ratio of emitter resistor R14 to collector resistor R15, and the amplified voltage is output from the collector. Also, an emitter follower is formed from npn transistor Q16, for which the collector is connected to power source Vcc1. The collector voltage of npn transistor Q15 is input to its base. The output current of the emitter follower is input through resistor R16 to a current mirror circuit composed of npn transistors Q17 and Q18. Output current 16 of the current mirror circuit is input to the connected common emitters of the second transistor pair composed of npn transistors Q21 and Q22. Differential voltage v2 is input to the pair of bases of said second transistor pair.

One collector current of the first transistor pair and one collector current of the second transistor pair, which vary in opposite direction with respect to change in differential voltage v2, are synthesized at the connecting nodes between terminals To and To' and their collectors, respectively, and they flow through resistors R17 and R18 to power source Vcc1.

In the aforementioned constitution, the multiplier can function at a power source voltage lower than that of the Gilbert cell shown in FIG. 8. Also, the constitution of the multiplier is simpler than the multipliers shown in FIGS. 9 and 10. Besides, since a pnp transistor is not used in this multiplier, the frequency characteristics become better than those of the multiplier shown in FIG. 9. In addition, it is possible to realize distortion characteristics equal to, or better than, those of the Gilbert cell.

This invention is not limited to the aforementioned embodiments. Various modifications that are well known to specialists can be made.

For example, the transistors used in this embodiment are not limited to npn transistors. Other types of transistors may also be used.

For the multiplier of this invention, first of all, a multiplication operation can be performed at a power source voltage lower than that of the Gilbert cell and with a simpler constitution. Second, it can realize multiplication operation at a power source voltage lower than that needed for the Gilbert cell, without using pnp transistors.

The invention claimed is:

1. A multiplier comprising:

a first current output circuit that has an input portion, which has one signal of a first differential signal applied to it, and a current output portion which outputs a first current corresponding to said one signal;

a second current output circuit that has an input portion, which has another signal of said first differential signal applied on it, and a current output portion which outputs a second current corresponding to said another signal;

a first transistor pair that has a first transistor and a second transistor, to which a second differential signal is applied, and feeds said first current;

a second transistor pair that has a third transistor and a fourth transistor, to which said second differential signal is applied, and feeds said second current;

a first resistor for feeding current to said second transistor and third transistor, and a second resistor for feeding current to said first transistor and fourth transistor;

a differential signal output from the connecting node between said first resistor and said second and third transistor and the connecting node between said second resistor and said first transistor and fourth transistor.

2. The multiplier described in claim 1 wherein the input portion of said first current feeding circuit is connected to a second power source voltage, and further comprises a fifth transistor with said one signal applied on its base;

and wherein the input portion of said second current feeding circuit is connected to the second power source voltage, and further comprises a sixth transistor with said another signal applied on its base.

3. The multiplier described in claim 2 wherein said first current feeding circuit is connected to the first power source voltage, and it further comprises a seventh transistor with the output signal of said fifth transistor applied to its base;

and said second current feeding circuit is connected to the first power source voltage, and it further comprises an eighth transistor with the output signal of said sixth transistor applied to its base.

4. The multiplier described in claim 3 wherein said first current feeding circuit has a first current mirror circuit composed of a ninth transistor connected to said seventh transistor and a tenth transistor connected to said first transistor pair; and said second current feeding circuit has a second current mirror circuit composed of eleventh transistor connected to said eighth transistor and a twelfth transistor connected to said second transistor pair.

5. The multiplier described in claim 4 wherein a third resistor is connected between said seventh transistor and said ninth transistor, and a fourth resistor is connected between said eighth transistor and said eleventh transistor.

* * * * *